US008800233B1

(12) United States Patent
Heartsfield et al.

(10) Patent No.: US 8,800,233 B1
(45) Date of Patent: Aug. 12, 2014

(54) MAT CONNECTING SYSTEM

(71) Applicant: Dollamur LP, Nashville, TN (US)

(72) Inventors: Gary Lynn Heartsfield, Bedford, TX (US); Conrad Jay Thompson, Nashville, TN (US); Gary Donald MacDowell, Nashville, TN (US); Chad Alan Lind, Nashville, TN (US); Jose Guadalupe Mejia, Nashville, TN (US)

(73) Assignee: Dollamur LP, Nashville, TN (US)

( * ) Notice: Subject to any disclaimer, the term of this patent is extended or adjusted under 35 U.S.C. 154(b) by 0 days.

(21) Appl. No.: 14/033,697

(22) Filed: Sep. 23, 2013

Related U.S. Application Data

(63) Continuation of application No. 13/625,958, filed on Sep. 25, 2012, which is a continuation-in-part of application No. 12/458,193, filed on Jul. 2, 2009, now Pat. No. 8,307,600.

(51) Int. Cl.
*E04B 2/00* (2006.01)
*A63B 26/00* (2006.01)

(52) U.S. Cl.
USPC ..... 52/582.1; 482/23

(58) Field of Classification Search
USPC ..... 52/177, 581, 582.1, 589.1, 591.1, 52/591.5, 592.1; 5/420; 482/23
See application file for complete search history.

(56) References Cited

U.S. PATENT DOCUMENTS

| | | | |
|---|---|---|---|
| 3,242,509 | A | 3/1966 | Nissen |
| 3,284,819 | A | 11/1966 | Nissen |
| 3,341,996 | A | 9/1967 | Jones et al. |
| 3,500,606 | A | 3/1970 | Wharmby |
| 3,636,576 | A | 1/1972 | Nissen |
| 3,694,983 | A | 10/1972 | Couquet |
| 4,168,061 | A | 9/1979 | Gordon |
| 4,169,688 | A | 10/1979 | Toshio |
| 4,274,626 | A | 6/1981 | Grosser et al. |
| 4,350,721 | A | 9/1982 | Nagase |
| 4,397,900 | A | 8/1983 | Higgins |
| 4,509,748 | A | 4/1985 | Bezak |
| 4,603,852 | A | 8/1986 | Breitscheidel et al. |
| 4,648,592 | A | 3/1987 | Harinishi |
| 4,807,412 | A | 2/1989 | Frederiksen |
| 4,860,510 | A | 8/1989 | Kotler |
| 5,052,158 | A | 10/1991 | D'Luzansky |
| 5,212,842 | A | 5/1993 | Glydon |
| 5,295,341 | A | 3/1994 | Kajiwara |
| 6,023,907 | A | 2/2000 | Pervan |

(Continued)

FOREIGN PATENT DOCUMENTS

| | | | |
|---|---|---|---|
| CN | 200945074 | Y | 9/2007 |
| DE | 202007014716 | U1 | 3/2008 |
| JP | 11-117557 | A | 4/1999 |

OTHER PUBLICATIONS

International Search Report and Written Opinion for International Patent Application Na PCT/US2009/004431 dated Sep. 15, 2009.

*Primary Examiner* — Jeanette E Chapman
*Assistant Examiner* — James Buckle, Jr.
(74) *Attorney, Agent, or Firm* — Bass, Berry & Sims PLC

(57) ABSTRACT

A fastening system for connecting mats is provided. The fastening system may include one or more features such as a hook and loop fastening system, a projection and trench fastening system, retainer and a tension strip securing system, and/or magnets to secure mats in place.

15 Claims, 8 Drawing Sheets

(56) References Cited

U.S. PATENT DOCUMENTS

| | | | |
|---|---|---|---|
| 6,098,354 | A | 8/2000 | Skandis |
| 6,684,592 | B2 | 2/2004 | Martin |
| 6,820,386 | B2 | 11/2004 | Kappeli et al. |
| 6,920,732 | B2 | 7/2005 | Mårtensson |
| 7,404,689 | B1 | 7/2008 | Poling |
| 2001/0017017 | A1 | 8/2001 | Pacione |
| 2002/0119275 | A1 | 8/2002 | Williamson |
| 2003/0154676 | A1 | 8/2003 | Schwartz |
| 2003/0219565 | A1 | 11/2003 | Heartsfield |
| 2004/0006903 | A1 | 1/2004 | Haytas |
| 2006/0127647 | A1 | 6/2006 | Thrush |
| 2006/0179751 | A1 | 8/2006 | Wei |
| 2008/0060305 | A1 | 3/2008 | Bengry et al. |
| 2008/0125290 | A1 | 5/2008 | Cabados |
| 2008/0295437 | A1 | 12/2008 | Dagger |
| 2009/0047451 | A1 | 2/2009 | Huss et al. |

MAT CONNECTING SYSTEM

This U.S. Continuation Application claims priority to U.S. application Ser. No. 13/625,958, filed Sep. 25, 2012, which is a U.S. Continuation-in-part Application that claims priority to U.S. patent application Ser. No. 12/458,193, filed Jul. 2, 2009, the disclosures of which are incorporated herein in its entirety by reference.

FIELD OF THE INVENTION

The present invention relates generally to mats used in athletic activities. More particularly, the present invention relates to a system for connecting mats together.

BACKGROUND OF THE INVENTION

Many indoor athletic activities such as wrestling, mixed martial arts, gymnastics, cheerleading, and many other activities use mats to provide a soft surface for the athletes. Many of these athletic activities occur in gymnasiums or other locations which are used for a variety of different purposes. Therefore, it is not always desired that the mats be positioned on the floor permanently or for long periods. Rather, mats are often spread out on a floor and removed depending on the activity to be conducted.

Often, several mats are arranged adjacent to each other in order to provide a large padded surface. When mats are arranged adjacent to each other, they can move or shift in position causing gaps between the mats. This is generally an undesirable condition for a variety of reasons. For example, if the mats move or shift with respect to each other, gaps may occur exposing unpadded portions of the floor. Also, the top surface of the mats may be noncontiguous which may also be undesirable.

Accordingly, it is desirable to provide a system for connecting mats together.

SUMMARY OF THE INVENTION

Because mats may be arranged on a floor for a specific activity and then be removed and stored when a different activity is to take place on the same floor, it is desirable to provide a system that allows the mats to be easily attached and separated. In some embodiments in accordance with the invention, the system is reusable in that it may permit the mats to be connected and then separated multiple times.

In some embodiments in accordance with the invention, the system may allow the mats to be attached to each other and form a substantially contiguous top surface. In other embodiments, the mats may be secured by a connecting system to reduce the likelihood of the mats moving with respect to each other to provide gaps between the mats.

In one aspect, a system is provided that, in some embodiments, provides a system for connecting mats together. The system may include a first and second mat having foam portions; a trench located in the foam portion of one of the mats, the trench spaced from an edge of the mat, the trench running substantially parallel to the edge of the mat; and a connector configured to be inserted into the trench to connect the first and second mats together, wherein when the mats are connected together, the mats define a substantially contiguous surface.

In accordance with an embodiment, a system is provided for attaching a plurality of mats together. The system may include a first mat having a foam portion, an upper extending portion that extends from an upper edge of a first sidewall of the first mat, and a flexible sheet on a top surface of the foam portion of the first mat and a top surface of the upper extending portion. The system may further include a second mat having a foam portion, a lower extending portion that extends from a lower edge of a first sidewall of the second mat, and a flexible sheet on a top surface of the foam portion of the second mat. The system may include a first attaching material attached to a bottom surface of the upper extending portion of the first mat, and a second attaching material attached to a top surface of the lower extending portion of the second mat, wherein, when the first attaching material and the second attaching material are connected to each other, the flexible sheet of the first mat and the flexible sheet of the second mat form a substantially contiguous surface.

In accordance with one embodiment of the present invention, a system for attaching mats together is provided. The system may include a mat having a top surface; a relief section in the mat interrupting the top surface, the relief section proximate to an edge of the mat; a first attaching material attached to the mat and located in the relief section; and a connector having a back surface, the connector including second attaching material attached to a surface opposite the back surface, the connector dimensioned and configured to fit in the relief section when the first and second attaching material are attached to each other, wherein the top surface of the mat and the back surface of the connector form a substantially contiguous surface when the first and second attaching material are connected to each other.

In accordance with another embodiment of the present invention, a system for attaching mats together is provided. The system may include a mat having a foam interior; a magnet located in a recess in the foam near an edge of the mat; and a seam in the foam running though the recess.

In accordance with yet another embodiment of the present invention, a system for retaining mats is provided. The system may include a first retainer; a second retainer; and a tension strip configured to removably connect to the first and second retainers to retain mats between the first and second retainers, wherein each retainer comprises: an anti-lifting plate; a retaining plate mounted to the anti-lifting plate wherein the anti-lifting plate extends past the retaining plate; and a connector attached to the anti-lifting plate on a side of the anti-lifting plate opposite to the retaining plate, the connectors configured to attach to the tension strip via a hook and loop connection.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
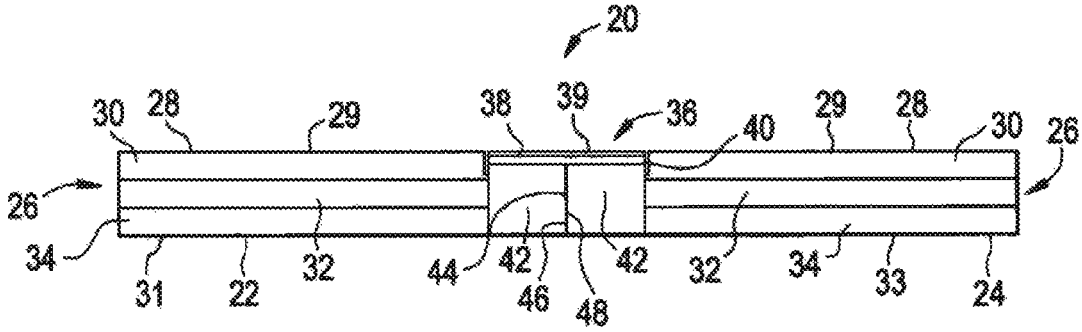
FIG. 1 is a side view of two mats connected together by a mat connecting system in accordance with one embodiment in accordance with the present invention.

Various embodiments of the invention will now be described with reference to the drawing figures, in which like reference numerals refer to like parts throughout. An embodiment in accordance with the present invention provides a system for retaining or connecting mats together. Mats are often arranged on the floor to provide a padded surface for conducting athletic activities.

Embodiments in accordance with the present invention may provide a system for retaining the mats together or connecting the mats together so that multiple mats arranged adjacent to each other can provide a large padded surface. A variety of different mats may be used in accordance with the invention.

In one example embodiment shown in FIG. 1, a mat retaining system 20 is used to connect two mats together. As shown and oriented in FIG. 1, a mat 22 is located on the left and a mat 24 is located to the right. The mats 22, 24 each include a foam portion 26. The foam portion 26 may be a polyethylene foam, but other types of foam or padding may also be used. The foam portion 26 may be topped with a flexible sheet 28. The flexible sheet 28 protects the foam portion 26 and provides a top or working surface 29 upon which the athletic activities are accomplished. The flexible sheet 28 may be vinyl, carpet, such as a needle punch carpet, or any other suitable surface. The flexible sheet 28 may be very thin when compared to the foam portion 26. The foam portion 26 shown in FIG. 1 includes a top foam layer 30 located just beneath the flexible sheet 28. A middle foam layer 32 and a bottom foam layer 34. Other mats in accordance with the invention may include more or fewer layers.

In the example shown in FIG. 1, the middle foam layer 32 is made of a comparatively heavier and stiffer foam than the top foam layer 30 and the bottom foam layer 34. For example, the middle foam layer 32 may weigh four pounds per cubic foot, whereas the top foam layer 30 and bottom foam layer 34 may weigh 2.2 pounds per cubic foot. Other weights of foam may also be used.

The foam layers 30, 32, 34 may be laminated together by a flame laminating process. A top or bottom surface of one foam layer may be heated by being exposed to a flame to partially melt the foam layer. Then the foam layer is attached to a second foam layer. The two foam layers then may be run between two rollers to compress and attach the two foam layers together. In some embodiments, the foam layers may each be about ⅝ of an inch in thickness, but other thicknesses may be used. The flame lamination method may include heating one of the foam layers so that about ⅛ of an inch of the layer is heated to a molten state, then the two foam layers are attached. The above process is described by example only, and other ways of attaching the foam layers may also be used.

In some embodiments in accordance with the invention, the foam portion 26 may also be flame laminated to the flexible sheet 28 in a process similar to that described above. Other mats may be made by sewing, gluing, or otherwise attaching the flexible sheet 28 to a foam layer. Some mats may only use one layer of foam, two layers or more layers than the three described with respect to FIG. 1.

Figure 5:
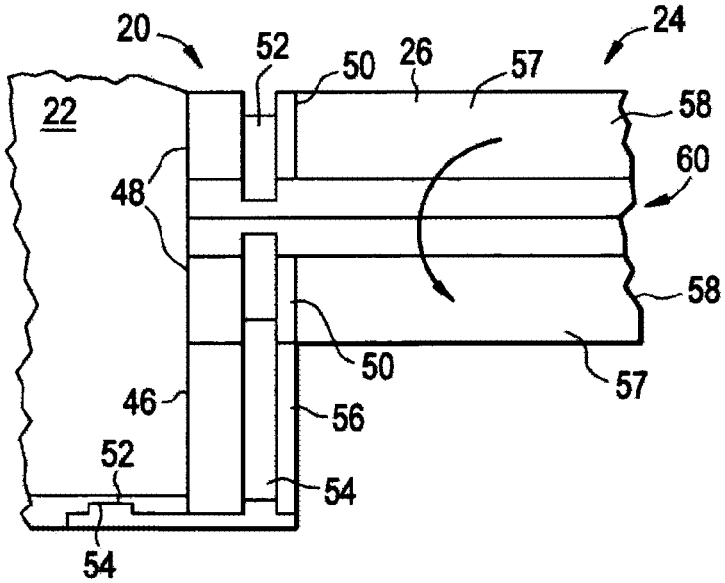
FIG. 5 is a perspective view of two mats being connected to each other according to the mat connecting system shown in the embodiment of FIGS. 2-4.

Some mats may be segmented in order to allow the mats to be folded for storage. Other mats (as shown in FIG. 5 and described in more detail with respect to FIG. 5) may be segmented into smaller segments so that the mats may be rolled up for storage. The mats 22 and 24 may have slits 60 located in the bottom of the foam portion 26 in order to allow the mats to roll up.

As shown in FIG. 1, both the left mat 22 and the right mat 24 include a relief section 36. In one example embodiment, the relief section 36 may be formed by removing a section of the flexible sheet 28 and a portion of the top foam layer 30 from each mat 22 and 24. In one embodiment, the relief section 36 may have a depth of about 3/16 of an inch or less. An attaching material 42 is positioned in the relief section 36. The mats 22 and 24 are arranged so the removed sections are aligned with each other to form a large relief section 36 as shown in FIG. 1.

A connector 38 is placed in the relief section 36 and connects the mats 22 and 24 together. The connector 38 includes an attaching material 40. The bottom of the relief section 36 of the mats 22 and 24 have a corresponding attaching material 42. The attaching material 42 in the relief section 36 of the mats 22 and 24 attach to the attaching material 40 on the connector 38. In some embodiments of the invention, the attaching material 40 and 42 is a hook and loop attaching material. An example of a hook and loop material is a series of products sold under the name VELCRO.

According to some embodiments of the invention, the hook portion of the attaching material 40 is located on the connector 38 and the loop portion of the attaching material 42 is mounted to the mats 22 and 24. The loop attaching material 42 may be attached to the foam portion 26 of the mats 22 and 24 by any suitable method such as, but not limited to, flame lamination, gluing, using double sided tape, and sewing. Loop material provided with an adhesive on the back may also be used. In some embodiments of the invention, the loop material 42 is attached to the mats 22 and 24 and the hook attaching material 40 is attached to the connector 38. When the loop material 42 is attached to mats 22 and 24, the loop material 42 may extend over the sidewalls of mat 22 and sidewalls of mat 24. The loop material 42 may further extend around the sidewalls of mat 22 and the sidewalls of mat 24 to a back surface 31 of mat 22 and a back surface 33 of mat 24. The hook attaching material 40 may also extend around sidewalls of the connector 38 and may further extend around the sidewalls of connector 38 to a top surface 39 of connector 38. The hook attaching material 40 is attached to the connector 38 because when a hook and loop attaching system starts to fail, often it is the hook portion 40 that fails first. Thus, when the hook attaching material 40 begins to fail, a new connector 38 having a new hook attaching material 40 may be used to replace an old worn-out hook attaching material 40. Replacing the connector 38 is easier than replacing worn hook attaching material 40 from the mats 22 and 24. However, the invention is not limited to such an arrangement. Other embodiments may include the hook attaching material 40 connected to the mats 22 and 24 and the loop attaching material 42 connected to the connector 38.

In some embodiments of the invention, the attaching material 40 may be connected to the connector 38 by glue, double sided tape, an adhesive backed to the attaching material 46, sewing, or any other suitable method. The connector 38, the attaching materials 40 and 42, and the relief section 36 are dimensioned so that when the connector 38 is attached via the attaching material 40 and 42 to the mats 22 and 24 and the top surface 39 of the connector 38 forms a substantially contiguous surface with the working surface 29 of the mats 22 and 24.

As shown in FIG. 1, a seam 44 between the mats 22 and 24 is formed by the right edge 46 of the left mat 22 and the left edge 48 of the right mat 24. According to an exemplary embodiment of the invention, the two mats 22 and 24 are brought close together to minimize the distance between the edge 46 and edge 48, thus minimizing the size of the seam 44 before the connector 38 is connected to the attaching material 42.

After reviewing the disclosure made herein, one skilled in the art will appreciate that the adhesiveness between the attaching material 40 and 42 should be selected to have a relatively high sheer strength in order to resist the mats 22 and 24 from being moved with respect to each other. However, the materials used in the attaching material 40 and 42 can also be selected to have a relatively low strength when being pulled apart from each other. In particular, care should be taken when selecting the attaching material that the bond between the hook and loop attaching material 40 and 42 is weaker than the bond between the attaching material 40, 42 and the foam portion 26 or connector 38. Otherwise, when the connector 38 is pulled away from the mats 22 and 24, rather than separating the hook and loop attaching material 40 and 42, the attaching material 40, 42 may be removed from the foam portion 26 or connector 38. Further, the hook and loop attaching material 40 and 42, when wrapped around the sidewalls and bottom surfaces, provides endurance and support of the attaching of the mats 22 and 24 with connector 38.

FIGS. 2-5 show another embodiment of a mat retaining system 20 in accordance with the invention. The left mat 22 is positioned adjacent to the right mat 24. The seam 44 occurs between the mats 22 and 24 between the edge 46 and the edge 48. The top of the mats 28 forms a substantially contiguous top surface 29. At the bottom of the mats 22 and 24 a relief portion 50 has been removed from the foam portion 26 of each mat 22 and 24. Within the relief portion 50 each mat 22 and 24 has a trench 52. The trench 52 is proximate or near the edge 46 or 48 of the mats 22 and 24. For example, the centers of the trenches 52 may be located about one inch from the edges 46 or 48. The centers of the trenches 52 may be about two inches from each other. The trenches 52 may be about 1 inch in width. While not shown, the mats shown in FIGS. 2-5 may be made of multiple layers as described with respect to FIG. 1.

Projections 54 are attached to connector 56. The connector 56 may be substantially rigid. The connector 56 may be segmented to permit the connector 56 to be rolled up for storage. The projections 54 in some of the embodiments may be made of the same foam material as the foam portion 26. In some embodiments, the actual foam removed to make the trenches 52 is attached to the connector 56 to form the projections 54. In other embodiments in accordance with the invention, the projections 54 may be made out of different foam or a more rigid substance such as plastic. Any suitable substance may be used in accordance with the invention.

Figure 2:
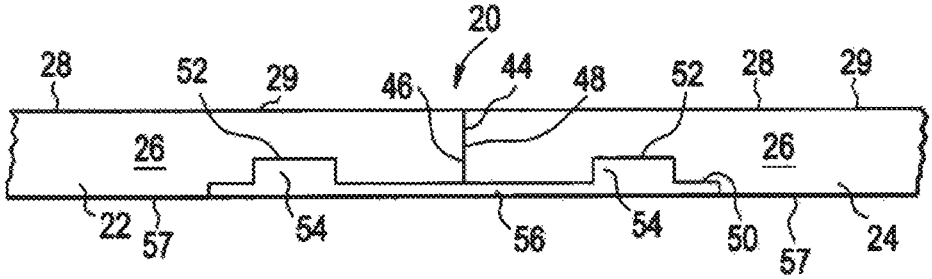
FIG. 2 is a side view of two mats connected together with a mat connecting system in accordance with another embodiment.

The connector 56 and the relief portion 50 are dimensioned so that the bottom of the connector 56 and fits flush with the bottom 57 of the mats 22 and 24 when the connector 56 is in the relief portion 50 as shown in FIG. 2. The interaction between the projections 54 and the trenches 52 lock the two mats 22 and 24 together to minimize the width of the seam 44.

Figure 3:
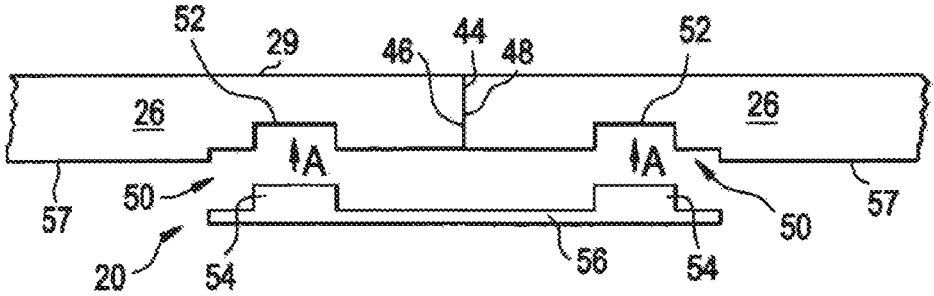
FIG. 3 is an exploded side view illustrating a connecting system in accordance with the embodiment shown in FIG. 2.

As shown in FIG. 3, the arrows A indicate how the connector 56 having the projections 54 fits into the relief portion 50 and the trenches 52.

According to some embodiments of the invention, the connector 56 may include a strip of polycarbonate material upon which two foam projections 54 are attached. The polycarbonate strip may have a thickness of 3/32 of an inch or less. The projections 54 may be attached to the polycarbonate strip by double sided tape, glue, flame lamination, or any other suitable method. The polycarbonate strip may be made of a product sold under the trade name LEXAN. The trenches 52 may have a depth of about half the thickness of the foam portion 26 of the mats 22 and 24. Other embodiments may include trenches 52 having other thicknesses.

While the connector 56 is described as including polycarbonate strip, a variety of other materials could be used in accordance with the invention. While the trench 52 and the projections 54 are shown as rectangular in the figures, the trench 52 and projections 54 may be chamfered, rounded, or have some other geometry that may assist the projections 54 in entering the trenches 52.

Figure 4:
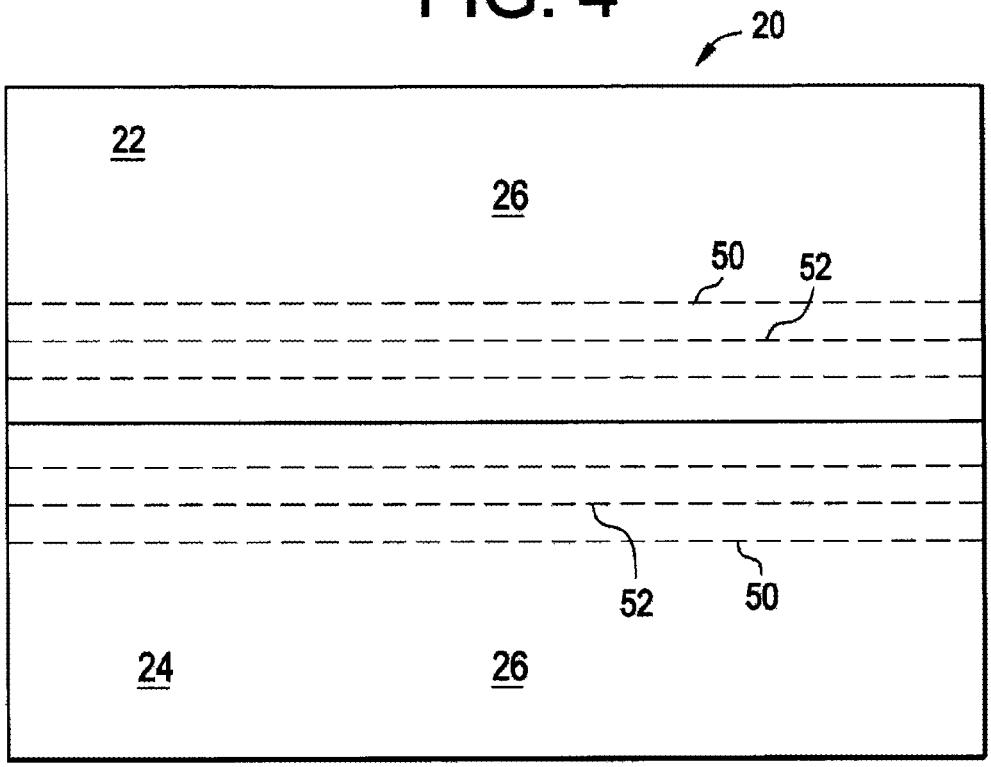
FIG. 4 is a top view of two mats connected together by a mat connecting system in accordance with the embodiment shown in FIGS. 2 and 3.

FIG. 4 illustrates the mats 22 and 24 laying adjacent to each other connected by connections system 20 shown in FIGS. 2, 3, and 5. The relief portion 50 and trench 52 in the foam portions 26 are shown in phantom lines as they are hidden in the view shown in FIG. 4.

Turning now to FIG. 5, the mat retaining system 20 of FIGS. 2-5 is shown in a perspective view. The connector 56 is arranged having the projections 54 extending upward. The left hand mat 22 has been arranged to have the projection 54 located in the trench 52. The right hand mat 24 is in a partially rolled up state. Slits 60 in the bottom of the foam portion 26 divide the mat 24 into several segments 58. The slits 60 do not extend through the flexible sheet 28 (the flexible sheet 28 is not shown in FIG. 5, but is shown, for example, in FIG. 2). In some embodiments the slits 60 do not extend all the way through the foam portion 26. The slits 60 aid in allowing the mat 24 to roll up when not in use.

The right hand mat 24 has been positioned adjacent to the left hand mat 22. The right hand mat 24 has been partially unrolled so that some of the segments 58 (hidden in FIG. 5) have the trenches 52 aligned with and containing the projection 54. The right hand mat 24 unrolls in the direction as shown by the arrow in FIG. 5. As the right hand mat 24 unrolls, the various segments 58 lay down flat and the trench 52 contains the projection 54 and achieves the position shown in FIGS. 2 and 4 when the mat 24 is fully unrolled.

The mats 22 and 24 can be rolled up by rolling the mats 22 and 24 in the direction opposite the arrow shown in FIG. 5. According to some embodiments of the invention, the segments 58 may be about 4 inches in width. While the seam 44 is shown as a straight seam in FIGS. 2-5, a step seam 44 as shown in FIG. 7 may also be used in accordance with the connecting system 20 shown in FIGS. 2-5.

Figure 6:
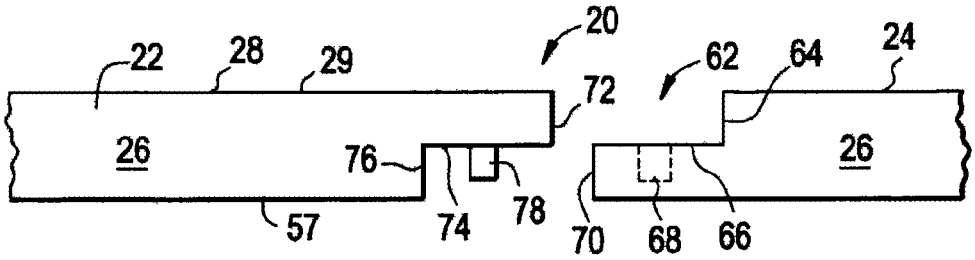
FIG. 6 is a side view of two mats having a connecting system in accordance with another embodiment.
Figure 7:
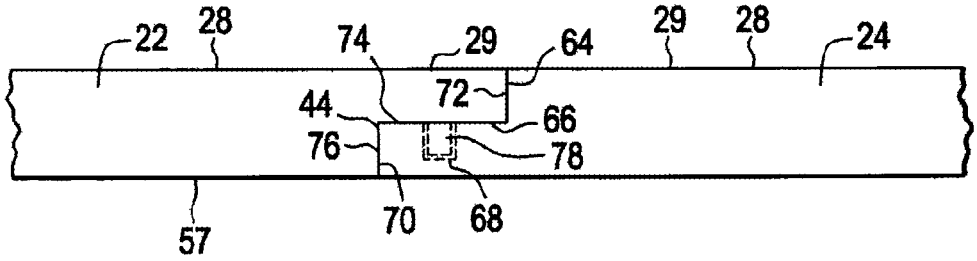
FIG. 7 is a side view of two mats connected to each other using a connecting system in accordance with the embodiment shown in FIG. 6.
Figure 8:
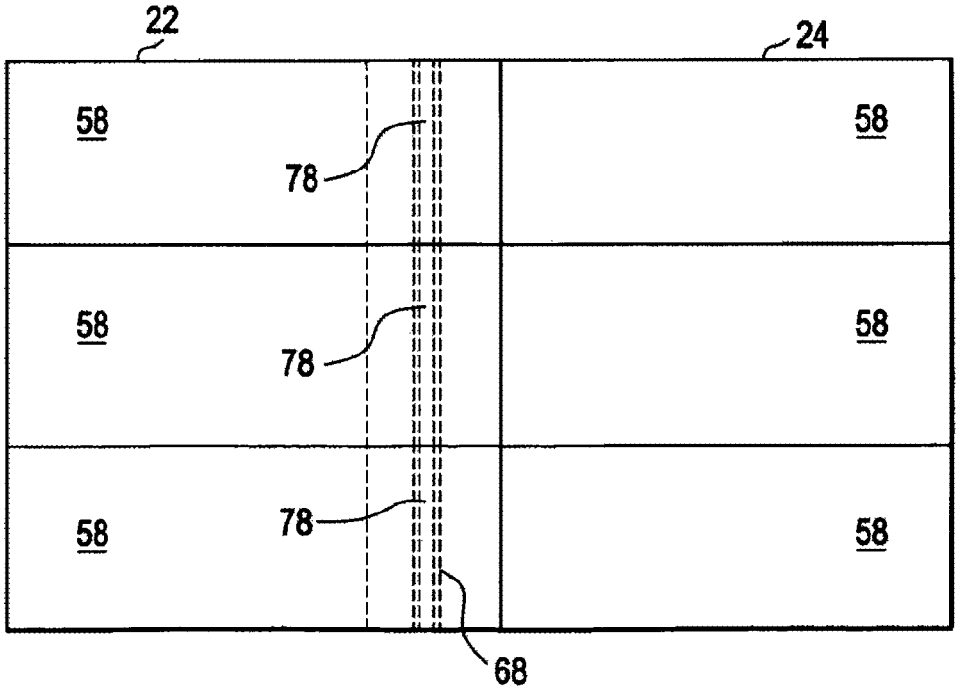
FIG. 8 is a top view of two mats connected to each other using a connecting system according to the embodiment shown in FIGS. 6 and 7.

FIGS. 6-8 illustrate a mat connecting system 20 in accordance with another embodiment of the invention. As shown in FIG. 6, the left mat 22 includes a foam portion 26 having a flexible sheet 28 to define a substantially flat top surface or working surface 29. The mats 22 and 24 may be layered and made similarly to the mats described above in the embodiments of FIGS. 1-5. The left mat 22 and right mat 24 have a stepped portion 62. The stepped portion 62 includes a vertical surface 64 which may extend along about half the thickness of the mat 24, a horizontal surface 66, and a second vertical surface 70 in the right mat 24. In the horizontal surface 66 resides a trench 68. The trench 68 runs along the length of the mat 24 proximate to the lower vertical surface 70.

The left hand mat 22 includes a vertical surface 72 which extends along about half the thickness of the mat 22, a horizontal surface 74, and a second vertical surface 76. A projection 78 projects out of the horizontal surface 74. The projection 78 may be made of foam similar to the foam portion 26. In other embodiments, the projection 78 may be made of plastic or any other suitable substance. The projection 78 may be integral with the foam portion 26 or the projection 78 may be attached to the foam portion 26 in any suitable manner. The projection 78 is dimensioned to fit within the trench 68 as shown in FIG. 7. Putting the projection 78 into the trench 68 secures the left 22 and the right 24 mats to each other and allows the flexible sheets 28 of both the left and right mats 22 and 24 to form a substantially contiguous top or working surface 29.

The seam 44 is step shaped as shown in FIG. 7. In some embodiments in accordance with the invention, when the mats 22 and 24 are made, the trench 68 may be extruded. The projection 78 may be die cut. The left 22 and right 24 mats themselves may start out having a more rectangular cross section. A portion of the flexible sheet 28 may be removed from the left hand side of the right mat 24 to form the step portion 26 and the trench 68 is extruded. The left hand mat 22 may also start as having a more rectangular cross section. A portion of the foam portion 26 at the bottom part 57 of the mat 24 is removed. The projection 78 may be die cut and left attached to the form portion 26 in embodiments where the projection 78 is integral with the foam portion 26. The exposed foam may be coated for protection. Stress points in the system 20 may be reinforced.

FIG. 8 is a top view of mats 22 and 24 having a retaining system 20 similar to the embodiments shown in FIGS. 6 and 7. FIG. 8 illustrates the left 22 and right mats 24 divided up into segments 58 similar to that descried with respect to FIG. 5. The various segments 58 may be any suitable width, however in accordance with some embodiments of the invention, the segments 58 are about 4 inches wide. In the embodiment shown in FIG. 8, each segment 58 of mat 22 has its own projection 78. The right hand mat 24 has a single trench 68. In some embodiments, multiple trenches may be used; one for each section 58. While the projection 78 has been shown in the figures to project downward and the trench 68 has been shown to extend downward towards the floor, one skilled in the art would appreciate that the features of the retaining system 20 can be rearranged. For example, the projection 78 and trench 68 can be reversed so that the projections are on surface 66 of mat 24 could protrude up and fit into a trench 68 located upward and extending toward the flexible sheet 28 of mat 22.

Figure 16:
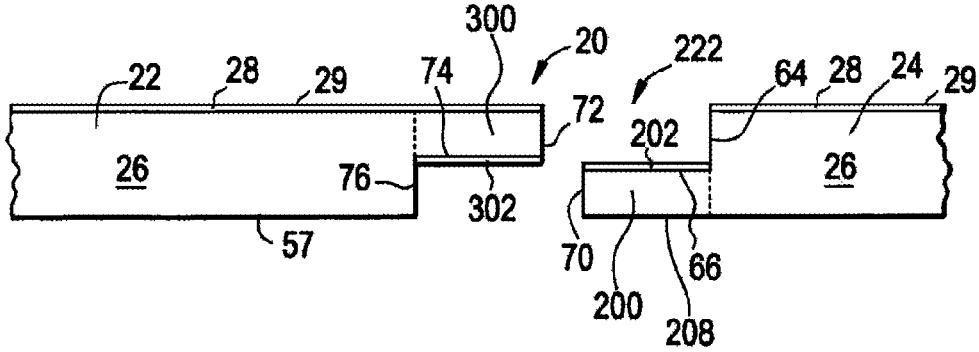
FIG. 16 is a side view of two mats having a connecting system in accordance with another embodiment.
Figure 17:
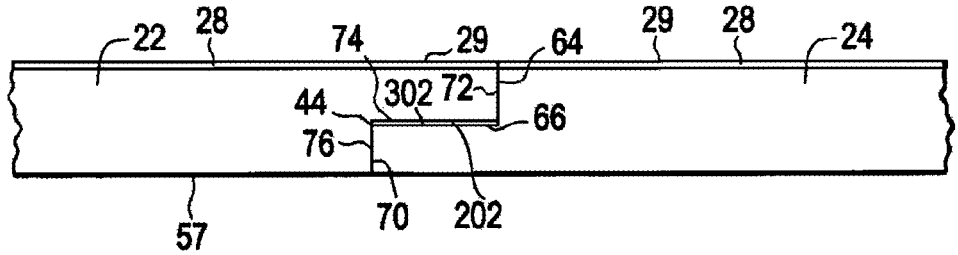
FIG. 17 is a side view of two mats connected to each other using a connecting system in accordance with the embodiment shown in FIG. 16.
Figure 18:
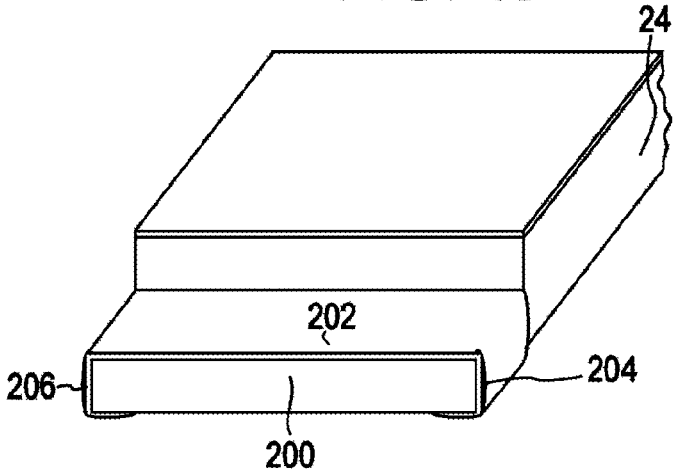
FIG. 18 is a perspective view of a mat to be connected by a connecting system according to another embodiment shown in FIG. 16.

FIGS. 16-18 illustrate a mat connecting system 20 in accordance with another embodiment of the invention. As shown in FIG. 16, the left mat 22 includes a foam portion 26 having a flexible sheet 28 to define a substantially flat top surface or working surface 29. Left mat 22 and right mat 24 may be layered and made similarly to the mats described above in the embodiments of FIGS. 1-8. The left mat 22 and right mat 24 have a connecting portion 222. For the right mat 24, the connecting portion 222 includes a lower extended portion 200 having a vertical surface 64 which may extend along from about the thickness of the flexible sheet 28 of the right mat 24 to about the full thickness of the foam portion 26, a horizontal surface 66, and a second vertical surface 70 in the right mat 24. On the horizontal surface 66, which is a top surface of the lower extending portion 200, the attaching material 202 may be, for example, a hook and loop attaching material or other attaching material that is capable of being attached and detached multiple times. An example of a hook and loop material is a series of products sold under the name VELCRO.

For the left mat 22, the connecting portion 222 includes an upper extending portion 300 having a vertical surface 72 which extends along from about the thickness of the flexible sheet 28 of the left mat 22 to about the thickness of the foam portion 26 of the left mat 22, a horizontal surface 74, and a second vertical surface 76. The attaching material 302 is attached to the horizontal surface 74, which is a bottom surface of the upper extending portion 300, and should be a corresponding attaching material used on the top surface of the lower extending portion 200. The thickness of the vertical surface 72 of left mat 22 is about the same as the thickness of the vertical surface 64 of right mat 24, and the thickness of the second vertical surface 76 of left mat 22 is about the same as the thickness of the second vertical surface 70 of right mat 24. Further, the length of the horizontal surface 74 of left mat 22 is about the same as the horizontal surface 66 of right mat 24. Accordingly, when left mat 22 and right mat 24 are secured by the attaching materials 302 and 202, the flexible sheets 28 of both the left mat 22 and the right mat 24 form a substantially contiguous top or working surface 29, as shown in FIG. 17.

Attaching material 302 may be, for example, a hook and loop attaching material or other attaching material that is capable of being attached and detached multiple times. An example of a hook and loop material is a series of products sold under the name VELCRO.

According to some embodiments of the invention, the loop portion of the attaching material 202 is located on the horizontal surface (top surface) 66 of the lower extending portion 200, and the hook portion of the attaching material 302 is mounted to the horizontal surface (bottom surface) 74 of the upper extending portion 300. The attaching materials 202 and 302 may be attached to the horizontal surfaces 66 and 74, respectively, by any suitable method such as, but not limited to, flame lamination, gluing, using double sided tape, and sewing. Attaching material provided with an adhesive on the back may also be used.

As shown in FIG. 18, when the attaching material 202 is attached to right mat 24, the attaching material 202 may extend over the sidewalls 204, 206 of right mat 24. The attaching material 202 may further extend around the sidewalls 204, 206 of right mat 24 to a back surface 208 of the lower extending portion 200. In another embodiment, the loop portion of the attaching material 302 is mounted to the horizontal surface (bottom surface) 74 of the upper extending portion 300, and the hook portion of the attaching material 202 is located on the horizontal surface (top surface) 66 of the lower extending portion 200. The attaching material 202, when wrapped around the sidewalls 204, 206 and back surface 208, provides endurance and support of the attaching and detaching of left mat 22 and right mat 24 from each other.

When the mats are detached from each other, the attaching material receives a lot of force that may eventually wear down the attaching methods that attaches the attaching material to the extending portions. By extending the attaching material to the sidewalls of the mat or extending the attaching material to the sidewalls and back surface of the mat, wearing of the attaching material may be greatly reduced.

Figure 19:
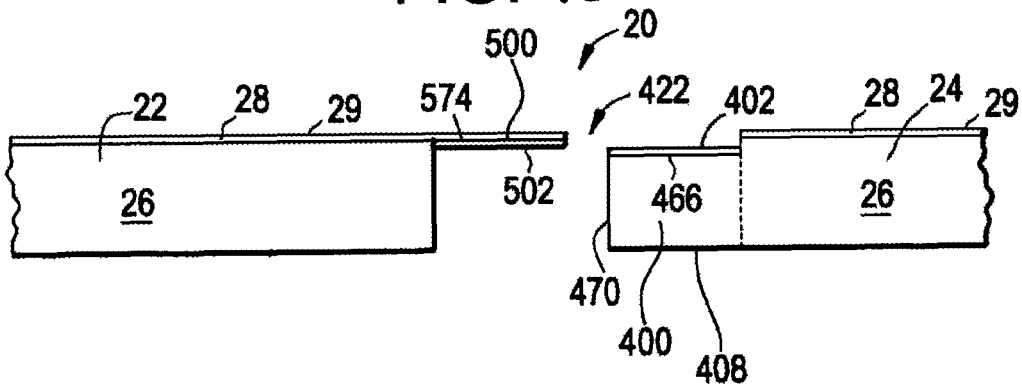
FIG. 19 is a side view of two mats having a connecting system in accordance with another embodiment.

FIG. 19 illustrates a mat connecting system 20 in accordance with another embodiment of the invention. As shown in FIG. 19, the left mat 22 includes a foam portion 26 having a flexible sheet 28 to define a substantially flat top surface or working surface 29. Left mat 22 and right mat 24 may be layered and made similarly to the mats described above in the embodiments of FIGS. 16-18. The left mat 22 and right mat 24 have a connecting portion 422. For the right mat 24, the connecting portion 422 includes a lower extended portion 400 having a vertical surface 470, which has a thickness of about the full thickness of the foam portion 26, and a horizontal surface 466 which is a top surface of the lower extending portion 400. An attaching material 402 may be, for example, a hook and loop attaching material or other attaching material that is capable of being attached and detached multiple times. An example of a hook and loop material is a series of products sold under the name VELCRO.

Figure 20:
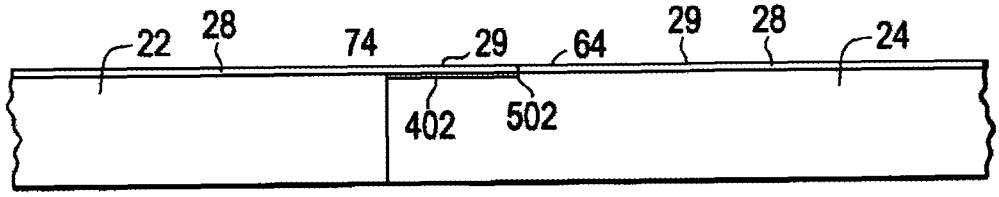
FIG. 20 is a side view of two mats connected to each other using a connecting system in accordance with the embodiment shown in FIG. 19.

For the left mat 22, the connecting portion 422 includes an upper extending portion 500. The upper extending portion 500 includes the flexible sheet 28 and an attaching material 502. The thickness of the upper extending portion 500 is about the thickness of the flexible sheet 28 of the left mat 22 and the thickness of the attaching material 502. The attaching material 502 is attached to a horizontal surface 574, which is a bottom surface of the upper extending portion 500, and should be a corresponding attaching material used on the top surface of the lower extending portion 400. The length of the horizontal surface 574 of left mat 22 is about the same as the horizontal surface 466 of right mat 24. Accordingly, when left mat 22 and right mat 24 are secured by the attaching materials 502 and 402, the flexible sheets 28 of both the left mat 22 and the right mat 24 form a substantially contiguous top or working surface 29, as shown in FIG. 20. This arrangement allows for a better fit and reduces the gaps in the seams of the mats.

The loop portion of the attaching material 402 is located on the horizontal surface (top surface) 466 of the lower extending portion 400, and the hook portion of the attaching material 502 is mounted to the horizontal surface (bottom surface) 574 of the upper extending portion 500. The attaching materials 402 and 502 may be attached to the horizontal surfaces 466 and 574, respectively, by any suitable method such as, but not limited to, flame lamination, gluing, using double sided tape, and sewing. Attaching material provided with an adhesive on the back may also be used.

Similar to FIG. 18, when the attaching material 402 is attached to right mat 24, the attaching material 402 may extend over the sidewalls of right mat 24. The attaching material 402 may further extend around the sidewalls of right mat 24 to a back surface 408 of the lower extending portion 400. In another embodiment, the loop portion of the attaching material 502 is mounted to the horizontal surface (bottom surface) 574 of the upper extending portion 500, and the hook portion of the attaching material 402 is located on the horizontal surface (top surface) 466 of the lower extending portion 400. The attaching material 402, when wrapped around the sidewalls and back surface 408, provides endurance and support of the attaching and detaching of left mat 22 and right mat 24 from each other.

When the mats are detached from each other, the attaching material receives a lot of force that may eventually wear down the attaching methods that attaches the attaching material to the extending portions. By extending the attaching material to the sidewalls of the mat or extending the attaching material to the sidewalls and back surface of the mat, wearing of the attaching material may be greatly reduced.

Figure 9:
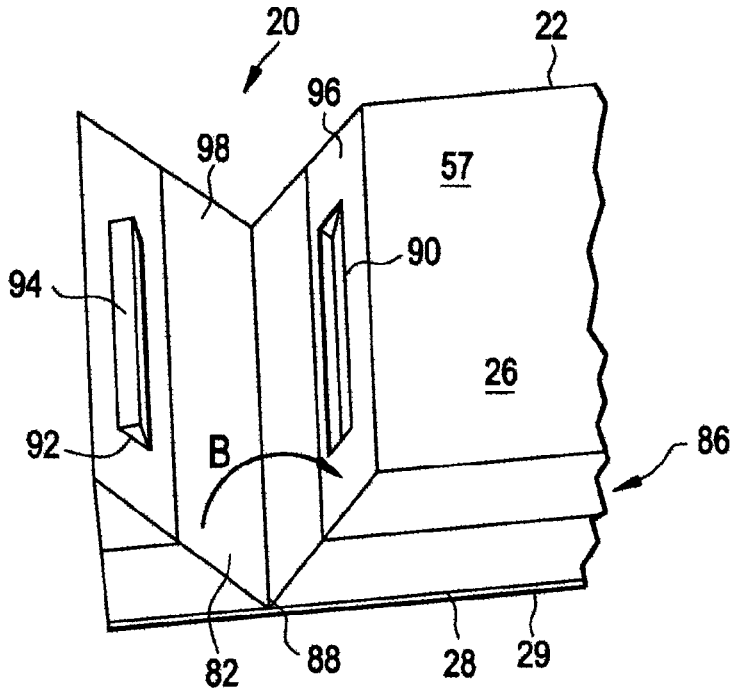
FIG. 9 is a perspective view of a mat being assembled having a connecting system according to another embodiment.
Figure 10:
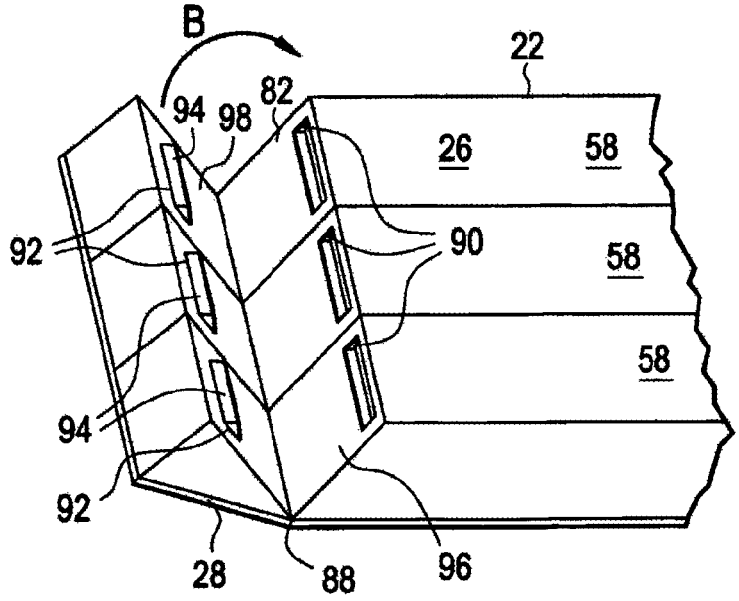
FIG. 10 is a perspective view of a mat being assembled having a connecting system according to another embodiment.
Figure 11:
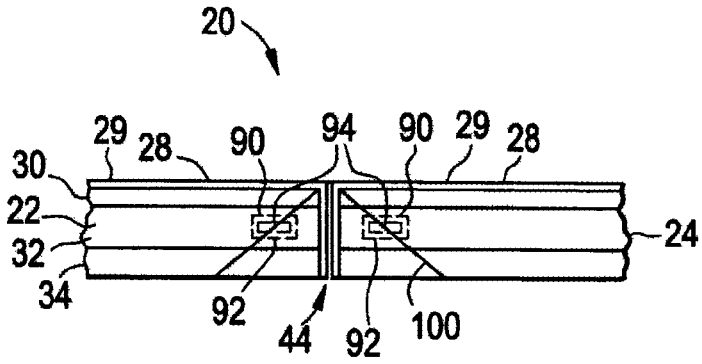
FIG. 11 is a side view of two mats connected together with a connecting system including magnets.

FIGS. 9-11 show embodiments in accordance with the invention where the mat retaining system 20 includes a magnet. FIG. 9 shows a mat 22 in a partial state of assembly and in an inverted position so that the top flexible sheet 28 is located on the bottom. While mat 22 is shown in FIGS. 9 and 10 the same depiction and description can apply to the right mat 24 because in the embodiment shown in FIGS. 9-11 the mats 22 and 24 are similar. The mat 22 includes a V-shaped trench 82 made when a portion of the foam portion 26 was removed. The walls 96 and 98 of the V-shaped trench may be cut at about a 45° angle with respect to the top surface 29 of the mats 22 and 24. The foam portion 26 may include several foam layers 86. The foam portions 26 and the flexible sheets 28 of the mats 22 and 24 may be constructed as described above. Two foam layers 86 are shown. Some embodiments in accordance with the invention may include more or fewer layers 86. For example, three layers 30, 32, and 36 are shown in FIG. 11. The bottom 88 of the V-shaped trench 82 is located at the flexible sheet 28. The flexible sheet 28 acts as a hinge to allow the mat 22 to be folded along the bottom 88 of the V-shaped trench 82 in the direction of arrow B.

FIG. 10 shows the mat in a partially folded position. FIG. 11 shows a side view of left hand mat 22 and a right hand mat 24 in a fully assembled and attached position.

Returning to FIG. 9, the V-shaped trench 82 includes an elongated hole 90 in the right hand side wall 96 of the V-shaped trench 82 and a hole 92 in the left hand side wall 98 of the V-shaped trench 82. The holes 90 and 92 may also be referred to as slots or recesses. These terms are intended to refer to a place for the magnet 94 to reside and be contained rather than a specific shape of the recess. Any suitably shaped recess may be used in accordance with the invention. The hole 92 in the left hand side wall 98 of the V-shaped trench 82 contains a magnet 94. The magnet 94 may be a rare earth magnet or any other magnet suitable for the purposes described herein. While the magnet 94 is shown in the hole 92 in the left side wall 98 of the V-shaped trench 82, the magnet 94 could also be located in the elongated hole 90 in the right hand side wall 96 of the V-shaped trench 82.

Once the magnet 94 is placed in one of the holes 92 or 90, the mat 22 is folded along the bottom 88 of the V-shaped trench 82 in the direction shown by arrow B until the side walls 96 and 98 are in contact with each other. The side walls 96 and 98 may be bonded to each other in a variety of ways. For example, glue, flame lamination, sewing or any other suitable technique for bonding the side walls 96 and 98 together may be used to bond the side walls 96 and 98 together. When the side walls 96 and 98 are bonded together, the magnet 94 is trapped within the elongated holes 90 and 92 as shown in FIG. 11.

FIG. 10 illustrates an embodiment similar to that shown in FIG. 9 where the mat 22 is comprised of several different segments 58. As shown in FIG. 10, each segment 58 has elongated holes 90 located in the side wall 96 and elongated holes 92 located in the side wall 98. Magnets 94 are located in the holes 92 as shown in FIG. 10 but in other embodiments, the magnets 94 could be located in the holes 90. The mat 22 is then folded in the direction of arrow B along the bottom 88 of the V-shaped trench 82 until the side walls 96 and 98 contact each other as shown in FIG. 11.

Having multiple magnets 94 located in a plurality of holes 90 and 92 in the various segments 58 offers the following advantage. As one mat 22 or 24 is rolled up, only one magnet 94 at a time is separated from a corresponding magnet in a corresponding segment 58. This makes it easier to separate the mats 22 and 24 when one of the mats 22 or 24 is being rolled up rather than separating all the magnets 94 at once by pulling two mats 22 and 24 apart from each other.

FIG. 11 shows a mat retaining system 20 using magnets. The left mat 22 is butted against the right mat 24. The magnet 94 is retained within the holes 90 and 92. The mats 22 and 24 are retained in place by the attraction of the magnet 94 in mat 22 to the magnet 94 in mat 24.

The seam 100, created by attaching walls 96 and 98 (shown in FIGS. 9 and 10) to each other, runs through the large hole comprised of the two holes 90 and 92. The flexible sheet 28 extends along the top portion of the mats 22 and 24 and turns at substantially a right angle and extends along the adjacent edges of the mats 22 and 24 as shown. The seam 44 formed by the two mats 22 and 24 is comprised of the two flexible sheets 28 from the mats 22 and 24 butting against each other. The mats 22 and 24 are held in place by the attraction between the magnets 94 contained in each of the mats 22 and 24. The flexible sheet 28 of the mats 22 and 24 comprise a substantially flat top surface or working surface 29. The mats 22 and 24 comprise three foam layers 30, 34, 36 described above. While the holes 90 and 92 are shown to be fully within the middle layer 34 other embodiments of the invention may locate the holes 90 and 92 within more than one layer. Further, some embodiments of the invention may include more or fewer layers of foam than that shown in FIG. 11. In some embodiments, the holes 90 and 92 may be lined with a reinforcing material.

Figure 12:
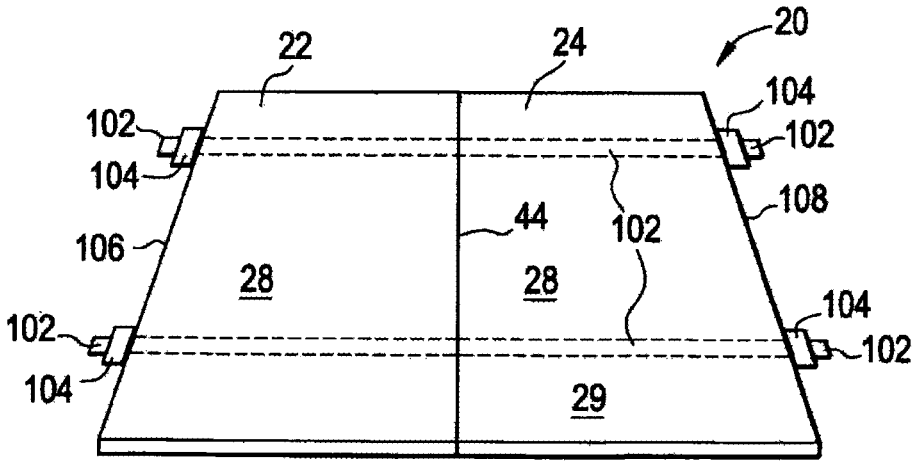
FIG. 12 is a perspective view of two mats connected together by a connecting system according to another embodiment.

FIGS. 12-15 illustrate a mat retaining system 20 in accordance with another embodiment. As shown in FIG. 12, a left hand 22 and right hand mat 24 are arranged adjacent to each other. The mats 22 and 24 butt up against each other forming a seam 44. The top sheets 28 of the two mats 22 and 24 form a substantially contiguous top or working surface 29.

The mat retaining system 20 keeps the mats 22 and 24 from spreading apart from each other. The mat retaining system 20 includes a tension strip 102. The tension strip 102 lays beneath the mats 22 and 24. Retainers 104 are located on, and attached to, the tension strip 102. The retainers 104 butt against the outer edges 106 and 108 of the mats 22 and 24 to keep the mats 22 and 24 from spreading apart from each other. Multiple sets of tension strips 102 and retainers 104 may be used.

Figure 13:
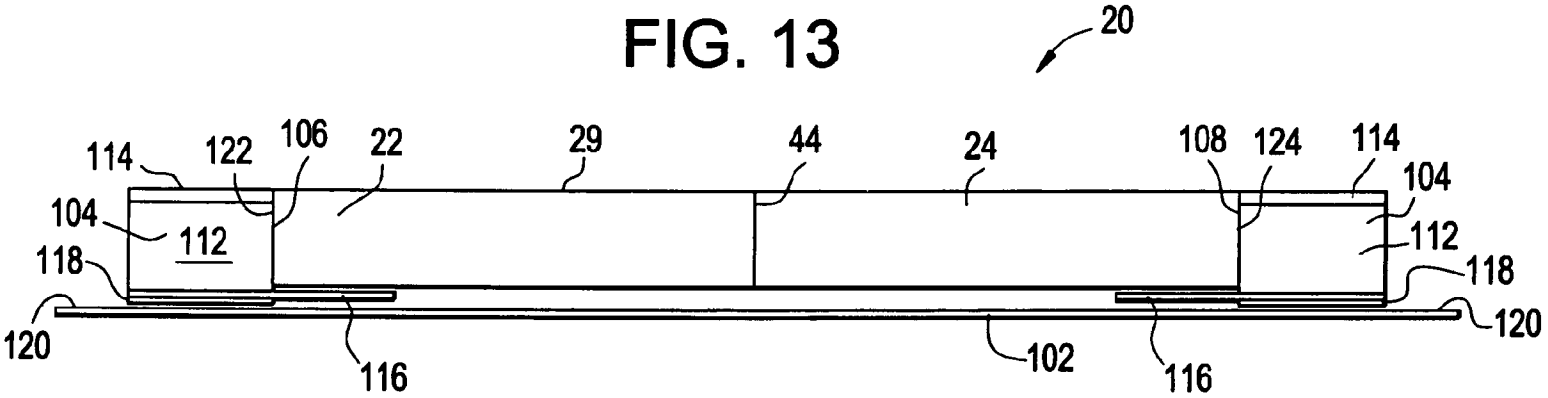
FIG. 13 is a side view of two mats held in place by a connecting system shown in FIG. 12.

FIG. 13 shows a side view of the retaining system 20 and mats 22 and 24. The tension strip 102 runs beneath the mats 22 and 24 and the retainers 104. The tension strip 102 may extend about two feet past each mat 22 and 24. The retainers 104 include a foam portion 112 and a top portion 114. The top portion 114 may be a carpeted surface or a flexible sheet similar to the flexible sheet 28 topping the mats 22 and 24. The top portion 114 forms a substantially continuous surface with the top portion 29 of the mats 22 and 24. The top portion 114 is attached to the foam portion 112 in any suitable manner.

Figure 14:
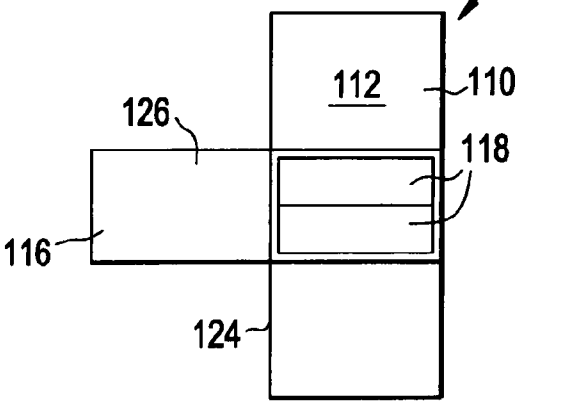
FIG. 14 is a bottom view of a portion of the connecting system shown in FIGS. 12 and 13.

The retainer 104 will now be described in more detail with reference to FIGS. 14 and 15. FIG. 14 shows a bottom view of the retainer 104. As shown in FIG. 14 the retainer 104 includes an anti-lift plate 116. The foam portion 112 is attached to the anti-lift plate 116 in any suitable manner. The anti-lift plate 116 is substantially rigid and maybe made of metal, plastic, or any other suitable substance. A connector 118 is attached to the bottom 126 of the anti-lift plate 116. The connector 118 may be one portion of a hook and loop attaching connector system, and in some embodiments of the invention, may be the loop portion of a hook and loop fastening system. As shown in FIG. 14, a connector 118 may include two strips of loop material attached to the bottom 126 of the anti-lift plate 116. The connector 114 has an edge 124 which butts against an edge 106 or 108 of the mat 22 or 24 shown in FIG. 13 to keep the mats 22 and 24 from moving away from each other.

Figure 15:
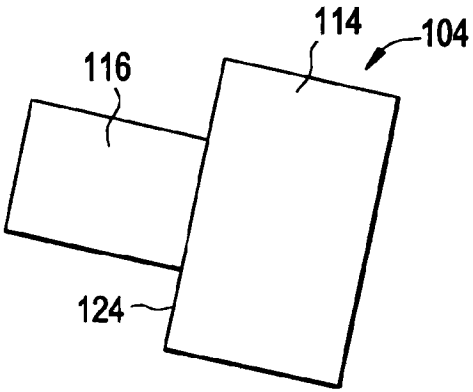
FIG. 15 is a top view of a portion of the connecting system shown in FIG. 14.

Turning now to FIG. 15, a top view of the connector 104 is shown. A top portion 114 is a carpeted portion, a vinyl sheet, or other flexible surface that forms a contiguous surface with the top portion 29 of the mats 22 and 24.

With reference to FIG. 13, the tension strip 102 may be a strip of hook fastening material 120 to which the loop connector 118 located on the retainer 104 is connected. Once a retainer 104 is attached to the tension strip 102, the mats 22 and 24 are placed on the tension strip 102. The mats 22 or 24 are pushed up against the edge 124 of the retainer 104. The mats 22 and 24 are also pushed against each other to minimize the seam 44. The tension strip 102 is then pulled tight and a second retainer 104 is put down and attached by hook and loop connection to the tension strip 102. The mats 22 and 24 are trapped between retainers 104. While FIG. 12 shows 2 sets of retainers 104 and tension strips 102, as many sets may be used as needed to secure groups of mats (the system 20 may connect more than just two mats) together. For example, one tension strip 102 and set of retainers 104 may be located every six feet along the mats.

In some embodiments, the anti-lift plate 116 is configured to prevent or reduce the likelihood of the retainer 104 from moving out of position due to the tension within the tension strip 102.

The various features of the mat retaining system 20 have been described herein according to one of the several embodiments set forth above. The various mat retaining systems 20 may mix and combine various features of the several embodiments in order to attach mats 22 and 24 to each other. For example, the tension strip 102 and retainer 104 may be used in conjunction with the other mat retaining systems described herein. Hook and loop fastening systems may also be combined with the projection and trench and/or magnet system. Further, the magnets and projection and trench systems may also be used together. While many of the seams have been shown as straight seams, step-type seams as shown and described herein may be substituted for straight seams as desired. After reviewing this disclosure, one skilled in the art may mix and match features of the various embodiments in accordance with the invention to provide a system tailored for particular application.

Some optional features may be common to various embodiments described herein. For example, the exposed foam may be coated to protect the foam. Stress points may be reinforced with coatings, inserts, or any other suitable material. Further, as described above, mats used in accordance with various embodiments of the invention may be made of a single or multiple layers of foam. Other padding may also be substituted for foam.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for attaching a plurality of mats together comprising:

a first mat having a cushioning portion, a flexible sheet on a top surface of the cushioning portion of the first mat, and a first attaching material attached and running parallel to an edge of the first mat;

a second mat having a cushioning portion, a flexible sheet on a top surface of the cushioning portion of the second mat, and a first attaching material attached and running parallel to an edge of the second mat; and a connector, including a second attaching material, that is configured to connect abutting sections of the first mat and the second mat together, wherein, when the first attaching material of the first mat and the first attaching material of the second mat are connected to the second attaching material of the connector, the first mat and the second mat with the connector define a substantially contiguous surface, and wherein at least one of the first attaching material of the first mat and the first attaching material of the second mat extends and is affixed onto at least one sidewall of the first mat and the second mat, respectively.

2. The system of claim 1, wherein the flexible sheet of the first mat and the flexible sheet of the second mat comprise at least one of vinyl and carpet.

3. The system of claim 1, wherein the cushioning portion of the first mat and the cushioning portion of the second mat include multiple segments.

4. The system of claim 1, wherein the cushioning portion of the first mat and the cushioning portion of the second mat include is foam.

5. The system of claim 1, wherein the cushioning portion of the first mat and the cushioning portion of the second mat include a plurality of layers of foam.

6. The system of claim 5, wherein a least one layer of foam of the plurality of layers of foam has a different rigidity than the other layers of foam of the plurality of layers of foam.

7. The system of claim 5, wherein each layer of foam of the plurality of layers of foam has a same rigidity.

8. The system of claim 1, wherein the first attaching material and the second attaching material are a hook and loop fastening system.

9. The system of claim 8, wherein the first attaching material is a hook portion of the hook and loop fastening system.

10. The system of claim 8, wherein the second attaching material is a hook portion of the hook and loop fastening system.

11. The system of claim 1, wherein the at least one of the first attaching material of the first mat and the first attaching material of the second mat that extends and is affixed onto the at least one sidewall of the first mat and the second mat, respectively, extends and is affixed onto at least one bottom surface of the first mat and the second mat, respectively.

12. The system of claim 1, wherein the first attaching material of the first mat extends and is affixed onto at least one sidewall of the first mat, and wherein the first attaching material of the second mat extends and is affixed onto at least one sidewall of the second mat.

13. The system of claim 12, wherein the first attaching material of the first mat extends and is affixed onto both sidewalls of the first mat, and wherein the first attaching material of the second mat extends and is affixed onto both sidewalls of the second mat.

14. The system of claim 12, wherein the connector is configured to connect abutting sections of the at least one sidewall of first mat and the at least one sidewall of the second mat together, when the first attaching material of the first mat and the first attaching material of the second mat are connected to the second attaching material of the connector.

15. The system of claim 13, wherein the connector is configured to connect abutting sections of both sidewalls of first mat and both sidewalls of the second mat together, when the first attaching material of the first mat and the first attaching material of the second mat are connected to the second attaching material of the connector.

* * * * *